US006367556B1

(12) United States Patent
Moore

(10) Patent No.: US 6,367,556 B1
(45) Date of Patent: Apr. 9, 2002

(54) MULTIPLE CONFIGURATION CENTRALIZER DEVICE AND METHOD FOR USING SAME

(76) Inventor: Curt A. Moore, 9725 Mission Gorge Rd., Ste 165, Santee, CA (US) 92071

( * ) Notice: Subject to any disclaimer, the term of this patent is extended or adjusted under 35 U.S.C. 154(b) by 0 days.

(21) Appl. No.: 09/565,935

(22) Filed: May 5, 2000

(51) Int. Cl.[7] ..... E21B 17/10

(52) U.S. Cl. ..... 166/378; 52/156; 52/677; 52/688; 166/241.1; 166/241.7; 405/184.4

(58) Field of Search ..... 52/156, 677, 688; 166/172.4, 241.1, 241.6, 241.7, 378; 175/325.1, 325.5, 325.7; 405/184.4, 259.1

(56) References Cited

U.S. PATENT DOCUMENTS 2,738,019 A * 3/1956 Atkinson ..... 166/241.7
3,055,432 A * 9/1962 Park ..... 166/241.7
3,525,224 A * 8/1970 Bardgette ..... 52/156 X
3,556,042 A * 1/1971 Laughlin ..... 166/241.7
4,042,022 A * 8/1977 Wills et al. ..... 166/241.7
4,219,081 A * 8/1980 Howe ..... 166/241.7
4,254,597 A * 3/1981 Feldman et al. ..... 52/156 X
4,794,986 A * 1/1989 Langer ..... 166/241.7
4,866,903 A * 9/1989 Ferstay ..... 52/677
5,339,896 A * 8/1994 Hart et al. ..... 166/241.1
5,785,125 A * 7/1998 Royer ..... 166/241.6 X
5,829,916 A * 11/1998 Evans ..... 405/184.4 X
6,102,118 A * 8/2000 Moore ..... 166/241.7

* cited by examiner

*Primary Examiner*—George Suchfield
(74) *Attorney, Agent, or Firm*—Richard D. Clarke

(57) ABSTRACT

A novel multiple configuration hand assembly centralizer system adaptable to virtually all known rock and soil anchoring applications is presented. The primary components to the centralizer include a plurality of straps and two collars which hold the straps in place utilizing a unique locking mechanism. Most preferably the standardized parts will be made from a petroleum based material. The straps are easily and manually inserted into slots in each of the collars. Each collar may be molded to provide slots for three or more straps. The collars are molded with grout passages between slots thereby allowing more than the required amount of grout to be fed through the centralizer. On a multiple configuration centralizer system, a housing assembly and retainer clip are used to frictionally hold the straps at user defined intervals on a standard zip tie. The flexibility and compressibility of the strap finger ends allows for adaptability of the centralizer device to various diameter elongated objects, such as rebar and corrugated pipe, to be centrally positioned. In addition, the centralizer system components and varying size of the straps permits easy manual assembly, on-site without the use of conventional tools, for numerous applications.

20 Claims, 10 Drawing Sheets

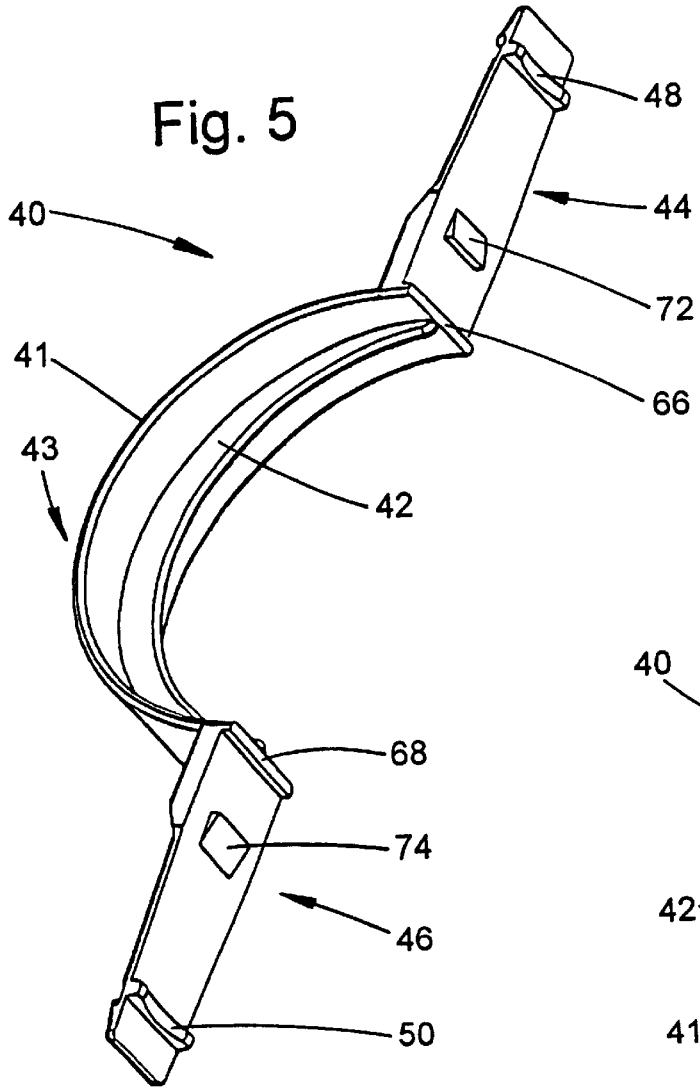
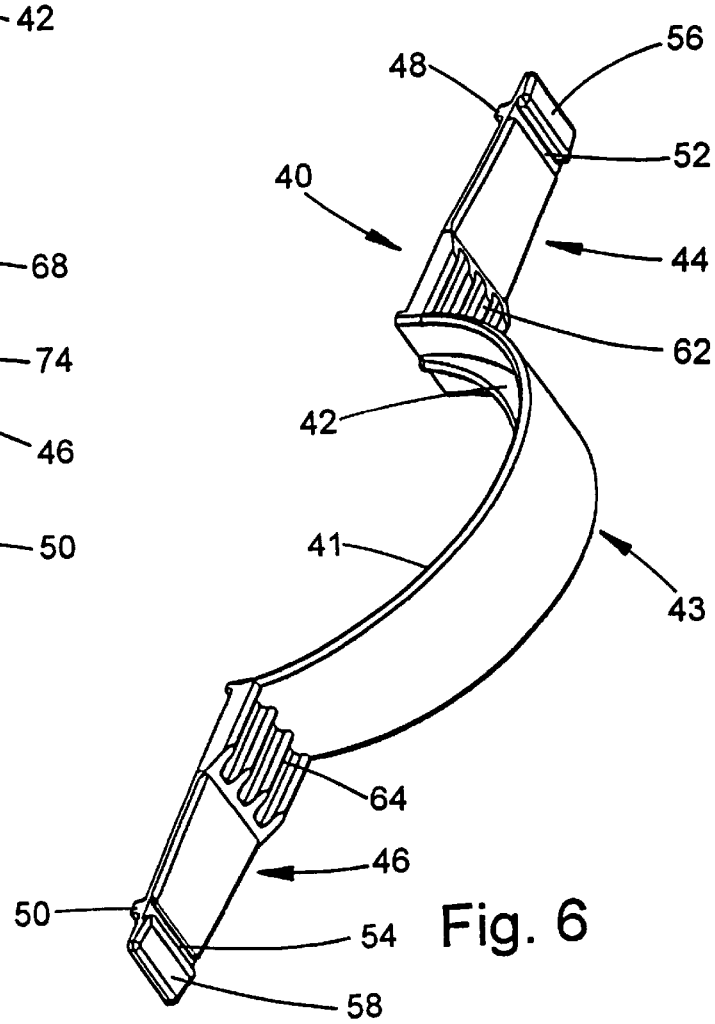
Fig. 6

Fig. 10
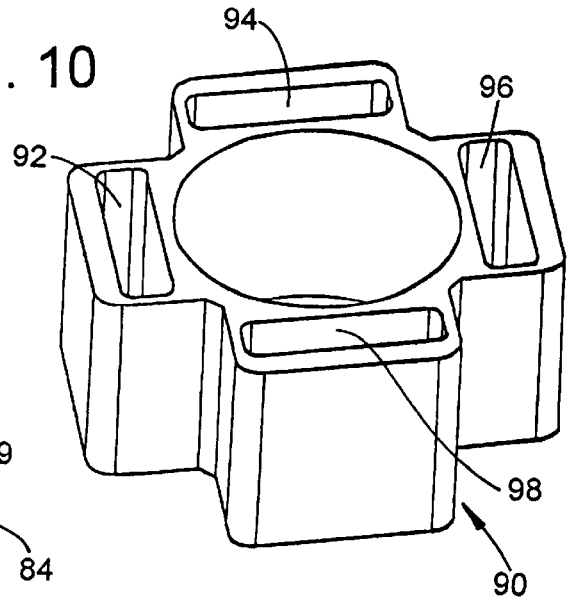
Fig. 9
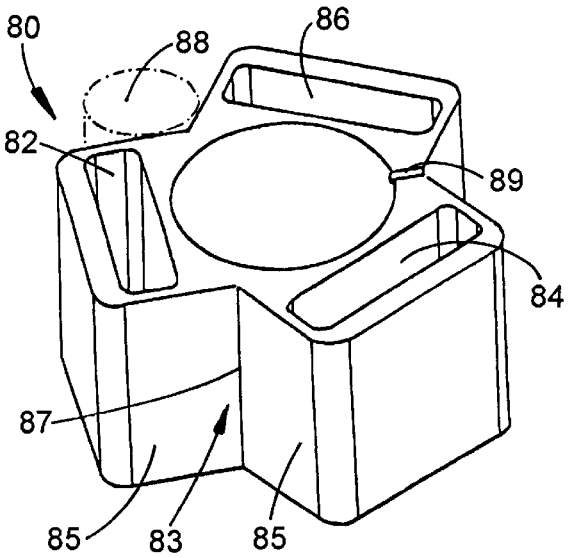
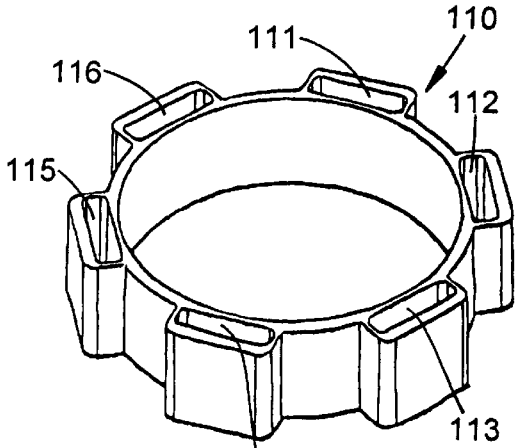
Fig. 12
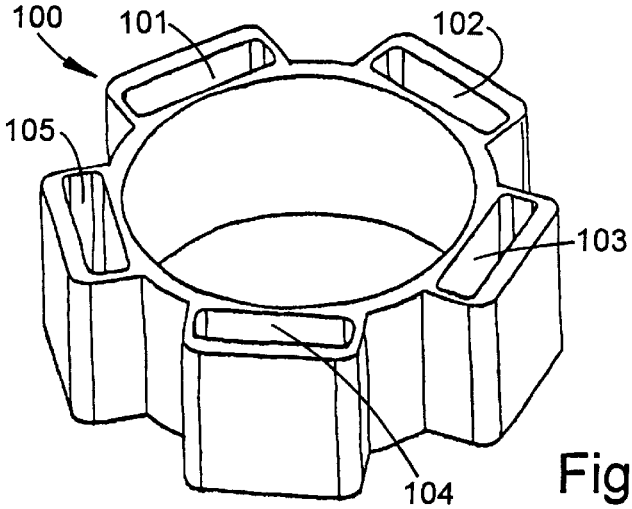
Fig. 11

MULTIPLE CONFIGURATION CENTRALIZER DEVICE AND METHOD FOR USING SAME

BACKGROUND OF THE INVENTION

1. Field of the Invention

The present invention relates generally to centralizer devices used in rock and soil anchoring applications in the construction industry. More particularly, the present invention relates to a novel centralizer device capable of multiple configurations, and capable of manual assembly from component parts, on-site at application construction sites, said assembly requiring no tools.

2. Description of the Related Art

Centralizers are devices used to provide space between an anchorage and the walls of an anchor bore hole, thereby allowing grout to be injected into the bore hole for securing of the anchorage. The centralizer field includes many different inventions which have attempted to improve the functions of the centralizer. Its two primary functions are to: 1) provide space between the anchorage and the walls of the bore hole, and 2) to provide a locking mechanism for the several centralizer elements so that they do not fail once installed in the ground.

More specifically, known relevant prior art has focused on improving the locking mechanism. Unfortunately, patented inventions in this field still exhibit many problems and disadvantages which the present invention has overcome. Even though previous designs have had some success in overcoming past problems, remaining problems include inflexibility in meeting multiple applications, relatively complex locking mechanisms, and using heavy materials such as steel. In addition, known prior art virtually neglects the problem of optimizing the space between the anchorage and the bore hole walls for each application. As is well known in the art, grout is used to secure the anchorage in a bore hole. The more secure the anchorage, the safer the entire anchor, thereby minimizing the possibility of a failure of a dam, a transmission tower, or an oil well, or other anchor applications.

Therefore, it is clear that a need exists for an improved centralizer device that is capable of multiple configurations, capable of being assembled on site, manually requiring no tools, from uniform components, provides an effective mechanism for grout flow, allows use in multiple applications, is light weight, strong, and is even more cost effective to manufacture and ship than existing centralizers. The present invention overcomes these and many other long-standing and even ignored problems and disadvantages of the prior art.

Some of the related prior art includes the following U.S. Patents: Wills, et al. U.S. Pat. No. 4,042,022; Ferstay U.S. Pat. No. 4,866,903; Chickini, Jr. et al. U.S. Pat. No. 4,247,225; Dane U.S. Pat. No. 4,077,470; Wilson U.S. Pat. No. 4,269,269; Spikes U.S. Pat. No. 4,651,823; Patterson et al. U.S. Pat. No. 4,909,322; Svenson U.S. Pat. No. 4,520,869; and Kraft U.S. Pat. No. 4,143,713.

Wills, et al. (U.S. Pat. No. 4,042,022) discloses a centralizer device with a plurality of blades received in slots by a pair of cylindrical collars. This invention is directed towards preventing the separation of parts during use. Disadvantages to this design include the lack of flexibility in the blade material, a design directed to a specific dimension envelope for the centralizer, and an assembly requiring hammers to insert the steel blades, and therefore requiring a lengthy assembly time.

Ferstay (U.S. Pat. No. 4,866,903) discloses a one piece centering device for thread bars. The device has holes to allow grout to pass around or through the device. Disadvantages to this device include restricted applications because of its small size, and lack of an expanding feature to fit different size bore holes. The device seems directed to use only in building applications. Another disadvantage is the small size of the holes in the device to allow grout to pass. It appears that it would be difficult for grout to pass through the small holes in sufficient quantities to provide sufficient force transfer to the ground for a safe anchor. Still another disadvantage is the use with threaded bar. Installing the device takes more time than would an non-threaded device.

Chickini, Jr. et al. (U.S. Pat. No. 4,247,225) discloses an alignment device comprising a single component for mounting an anchor cable in an elongated cable hole in a guy line anchoring environment. One disadvantage with this device is the fixed diameter of the collar for passing cable through. Another disadvantage is the small diameter of the collar for passing any cable through. Still another disadvantage is the somewhat complex locking mechanism to prevent the device from coming apart.

Dane (U.S. Pat. No. 4,077,470) discloses a well centralizer directed to an improved means to connect bow elements to collars. Disadvantages to this device include a complex connecting apparatus, limited applicability in that it is for use only in oil well casings, use of relatively heavy steel for material, and also a need to bend the locking tab to allow for locking the bow elements into the collars.

Wilson (U.S. Pat. No. 4,269,269) discloses a deformable tab on collars as a means to prevent each spring from disengaging from the end collars when the centralizer is subjected to compressional loading. One disadvantage to this device includes limited applicability in that use is only directed to oil, gas, or water drilling situations. Another disadvantage is that the deformable tab does not appear to be of a robust design, therefore the tab is likely to break. Still another disadvantage is that numerous conventional tools, including hammers, vises and pipe wrenches are needed for assembly. Yet another disadvantage is the metal material used requiring forging. The metal material, being relatively heavy compared to plastic, requires more costs for manufacture, crating and shipping.

Spikes (U.S. Pat. No. 4,651,823) discloses a well bore centralizer directed to an improved connectible means between the bowed elements and the collars. Disadvantages include a complex collar locking design, bow elements set to a specific arcuate position, and the hammer force required for assembly. Still another disadvantage is the use of metal in the design, thereby requiring more costs for manufacturing, crating and shipping.

Patterson et al. (U.S. Pat. No. 4,909,322) disclose a casing centralizer with bendable tab to allow a more improved locking mechanism to secure the bow springs in the collars. Disadvantages to this device are similar to others listed in previously mentioned prior art. One disadvantage is the inability of the device to be flexible thereby limiting its applicability to only certain sizes of bore holes. Another disadvantage is the use of metal which increases costs for manufacture, crating and shipping. Yet another disadvantage mentioned in some of the other prior art is the need to bend the metal before the bow springs can be inserted into the collars. Bending the metal can create a point for failure after installation.

Svenson (U.S. Pat. No. 4,520,869) discloses a centralizer for a well casing directed specifically to a third channel of the collar compressible at final assembly allowing for locking of the bow and collar together. Disadvantages in using this device include the complex locking mechanism, limited use to well casings, use of metal requiring more costs, and a need to use hammering tools before assembly can be completed.

Kraft (U.S. Pat. No. 4,143,713) discloses a self-centering basket for use in mining or oil fields. More specifically, the device is directed towards lugs to hold down steel bars to prevent the bars from jumping out of engagement. Disadvantages include the use of steel, thereby increasing manufacturing and shipping costs. Because the design is meant to be locked upon assembly, no means are provided for mistakes in assembly. It would appear to be virtually impossible to disassemble to correct mistakes. In addition, no means are disclosed for altering the outer dimensions of the device should the on site diameter of the bore hole be greater or less than expected.

In summary, all the cited patents have a multitude of disadvantages. As is quickly realized, most of the patents disclose similar attempts to solve one problem with previous centralizer designs. Most are directed to improving centralizer locking techniques. However, problems still exist with attempts to improve centralizer locking techniques. Therefore, it would be highly desirable to solve the locking problem with an elegant, simple, inexpensive centralizer design. In addition, it would be highly desirable to solve other problems in the field of centralizer devices that have been virtually ignored. Therefore, it is an object of the present invention to provide a multiple configuration capable centralizer device allowing hand assembly in the field at construction sites or other sites requiring centralizer applications. Also, the unique features of the present invention allow for its use in virtually any anchoring application situation. It is a further object of the present invention to use a non-metal material, thereby reducing costs throughout the manufacturing to end use process and eliminating the need for any use of conventional tools for assembly. Another object of the invention is to provide numerous interchangeable components for custom orders and multiple embodiments for optimized use in the field, such components allowing for rapid and simple hand assembly requiring no tools, on site, in customer required specifications.

SUMMARY OF THE INVENTION

Therefore, the principal object of the present invention is to provide a new and improved centralizer device that is capable of multiple configurations.

It is a further object of the present invention to provide such a new and improved centralizer device that is capable of being assembled on site, manually by hand using no tools, from standardized components.

It is yet a further object of the present invention to provide such a new and improved centralizer device that provides an effective mechanism for grout flow.

It is yet another object of the present invention to provide such a new and improved centralizer device that allows use in multiple applications and is light weight, yet strong. The rigid straps include a central portion semi-circular tapered riser which widens at its peak, and which radius determines the size of rigid strap to use in a given bore hole application, whereby said tapered riser which broadens in the center adds strength to said rigid strap member, and allows for less difficulty in inserting said centralizer system into said bore hole due to increased surface area.

It is yet another object of the present invention to provide such a new and improved centralizer device that is even more cost effective to manufacture and ship to application job sites than existing centralizers.

Briefly, the above and further objects of the present invention are realized by providing a new and improved centralizer device that provides for usage of a number of standardized parts, namely, collars and straps, which may be quickly assembled on-site in the field without the use of tools. These parts are interchangeable to allow for custom configuration of the centralizer device in the field as the circumstances dictate the application requirements.

The parts for the present invention include straps constructed to include three or more separate flexible finger portions, when fully assembled. These flexible finger portions flex toward and snugly fit onto an elongated object to be centrally positioned in a bore hole, and the finger portions allow for the centralizer to be mounted using tie wire or zip tie in grooves on each distal end. This permits the centralizer to be immobilized in position around the object to be centrally positioned in a bore hole. In addition, the collar locking mechanisms located on the straps allows for ease of assembly on location without the use of conventional tools.

The rigid straps include a central portion semi-circular tapered riser which widens at its peak. The radius of the riser determines the size of rigid strap to use in a given bore hole application. The tapered riser which broadens in the center adds strength to the strap and allows for less difficulty in inserting the centralizer system into the bore hole due to increased surface area. The straps include a centrally located gusset on one side, positioned within the curved inner portion to provide strength and reinforcement to the straps.

The straps also include one or more compression tabs on each end for enhanced attachment to an earth anchor rebar, a corrugated pipe or cable strands. The compression tabs are radially cut to provide a tighter conformed attachment to rounded earth anchor mechanisms. In this way, the compression tabs apply direct pressure opposite the tie wire to ensure centralizer movement or slippage is prevented. The rigid strap end consists of flexible fingers which can be compressed to conform to any diameter and can be wired snugly to an object to be centrally positioned.

Another standardized part for the novel centralizer device are two generally cylindrical collars having three or more strap slots which accept the flexible end finger portions of the straps. The individual straps are inserted into each collar manually. Once all straps are inserted in both collars, the centralizer is assembled manually by pushing from both ends, then locked with a unique locking tab mechanism. Therefore, the centralizer can be manually assembled when needed for any given application, and no separate conventional tools are required for centralizer assembly.

While most collars are solid and uniform, having no break or slit, some collars may include one slit to allow for the rapid mounting of the assembled centralizer system onto an elongated object without the need to slide the centralizer system down the length of the elongated object to be centrally positioned in the bore hole. In addition, the collars are constructed so as to provide areas for grout channels between the strap insets.

In a multiple configuration centralizer, a retainer housing having a single slot is used in place of the standardized collars. Each of the straps are manually insertable into the retainer housing slot and locked into place by a locking ramp. A tie retainer clip having a plurality of clip fastening tines each having a raised portion is inserted into the retainer housing slot and is locked into place. The raised portion of the tines locks into the locking ramps within the multiply grooved portion of the strap.

The retainer clip is capable of accepting a zip tie so that the novel multiple configuration centralizer is formed around an elongated object by threading a zip tie through each strap slot formed by the connection of the strap housing and the tie retainer clip. The resulting slot is sized so as to hold the zip tie very snugly, preventing undesired movement when mounting the assembled centralizer system onto an elongated object to be centrally positioned.

The unique locking mechanism includes a locking ramp positioned on an inside surface of the strap when the strap is inserted into the collar slot or the retainer housing slot. The locking ramp prevents movement of the collar along the strap. The straps are constructed with a portion that has a multiple grooves with each groove having a locking tab.

All standardized parts of the novel multiple configuration centralizer are constructed of a thermoplastic material including polypropylene and polyethylene which is easily moldable, provides strength, durability and economy of manufacturing.

The multi-configuration rigid strap centralizer system composed of a plurality of strap housings are fitted with a tie retainer clip and are economically shipped to, and provided on-site in a ladder-like configuration with two zip ties snugly connecting the straps.

Because of the molding process and the materials used for construction of the novel centralizers, costs for manufacturing, crating, and shipping are greatly reduced from the prior art devices. These, and other features and advantages of the present invention are set forth more completely in the accompanying drawings and the following detailed description of the drawings.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 5 is a back perspective view illustrating the strap in greater detail;

FIG. 6 is a front perspective view illustrating the strap in greater detail;

FIG. 9 is an enlarged perspective view of one embodiment of a typical collar illustrating three slots for straps and other details;

FIG. 10 is an enlarged perspective view of a second embodiment of a typical collar illustrating four slots for straps;

FIG. 11 is an enlarged perspective view of a third embodiment of a typical collar illustrating five slots for straps;

FIG. 12 is an enlarged perspective view of a fourth embodiment of a typical collar illustrating six slots for straps;

DESCRIPTION OF THE PREFERRED EMBODIMENTS

Figure 1:
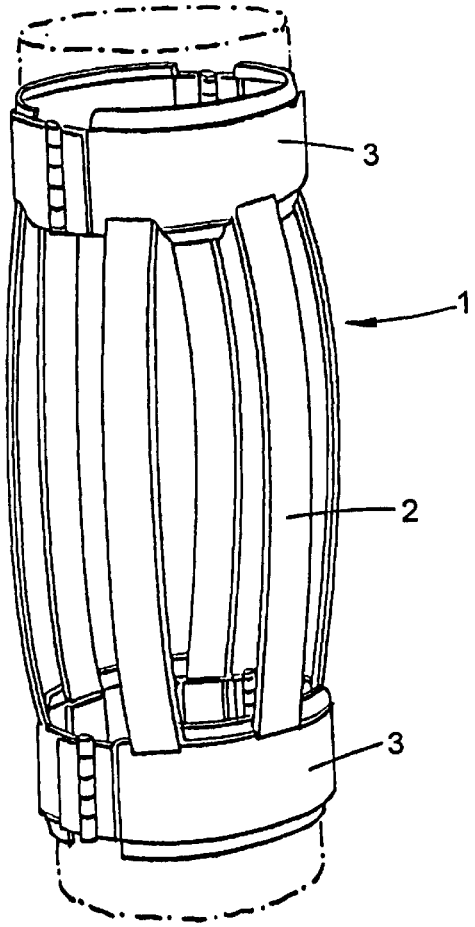
Fig. 1 PRIOR ART
FIG. 1 is a perspective view of a centralizer in the prior art, illustrating a blades and collar construction.

Referring initially to FIG. 1, a perspective view of an invention of the prior art is shown. A centralizer 1 is shown comprised of a plurality of straps 2 and two collars 3. This prior art (Spikes, U.S. Pat. No. 4,651,823) is generally representative of many of the cited prior art patents in the Background section above. The collars 3 show a complex metal hinged locking mechanism. The metal straps 2 are set to a specific arcuate position. The present invention makes novel improvements upon this prior art and those devices of the other patents cited.

Figure 2:
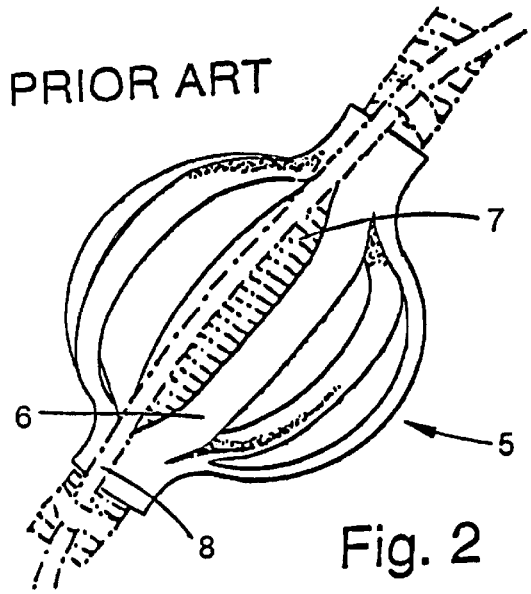
FIG. 2 is a perspective view of a typical PVC pipe derived centralizer as is currently constructed by convention, in place on a reinforcement bar (hereinafter "rebar") with a grout tube.

Referring now to FIG. 2, another prior art centralizer device 5 is shown here. This centralizer device 5 is derived from schedule 40 PVC pipe. During construction the PVC pipe is split and stretched apart to form the spacer members 6. It is shown in place on a "rebar", cable or strand 7 and having a grout tube 8 attached thereon.

Figure 3:
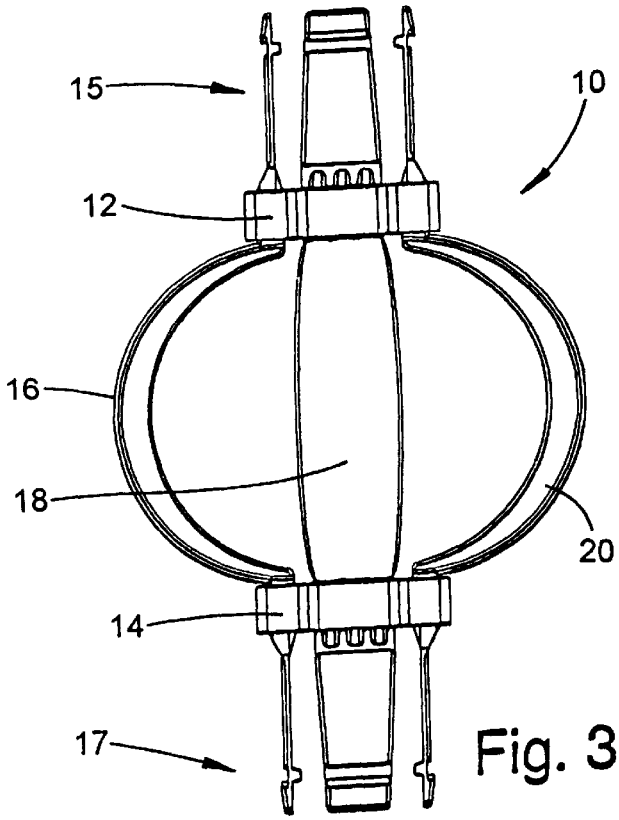
FIG. 3 is a front elevational view of an assembled centralizer illustrating the straps and collars, constructed in accordance with the present invention.

Turning to FIG. 3, there is shown a front elevational view of an embodiment of the novel centralizer device 10 constructed in accordance with the present invention. This centralizer 10 is composed of two collars 12 and 14 which hold in place a plurality of flexible strap fingers as exemplified by flexible strap fingers 20, 16 and 18. The portions of the flexible strap fingers 20, 16 and 18 which slide through and are held in place by the two collars 12 and 14 form the flexible strap fingers area 15 and 17.

Figure 4:
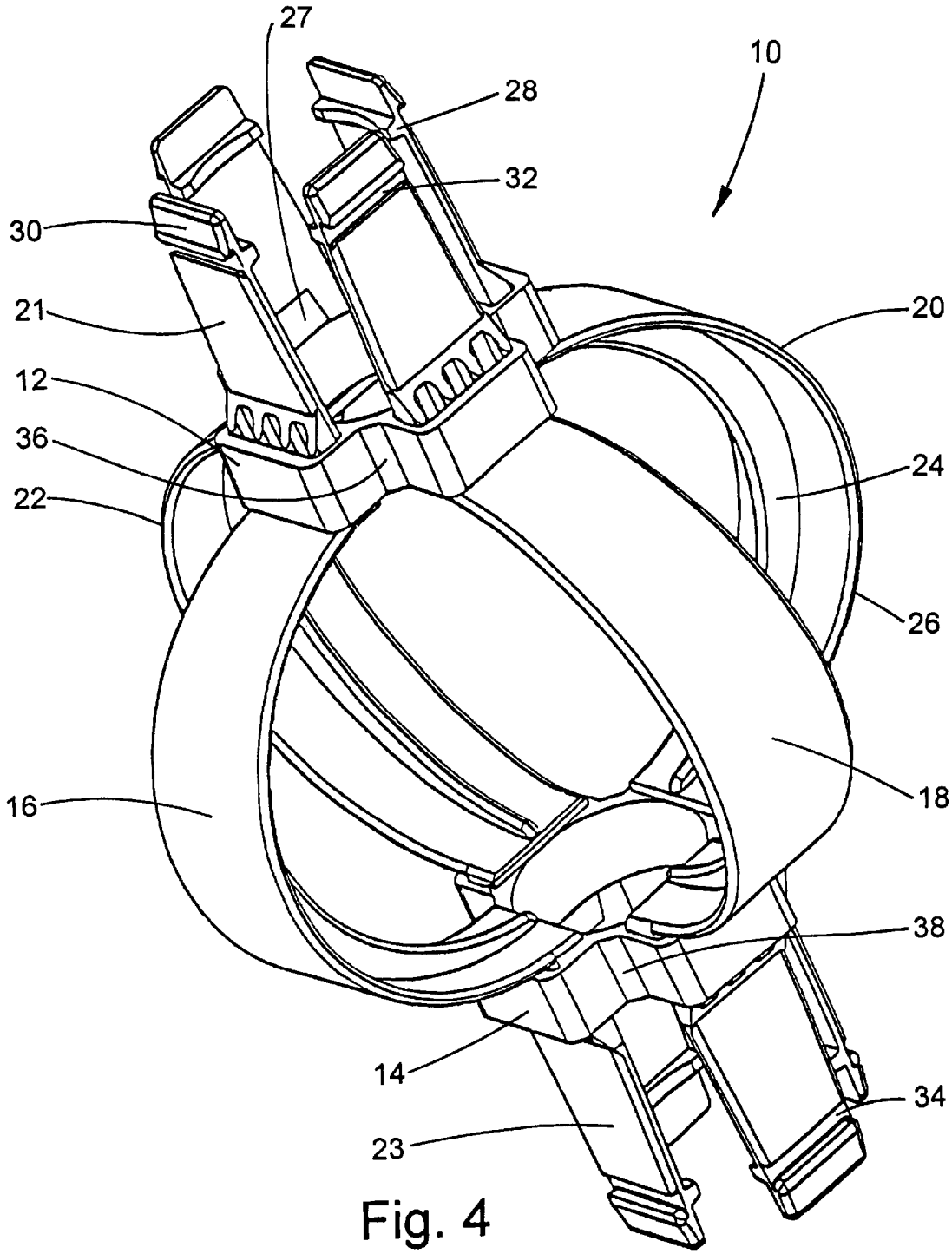
FIG. 4 is a front perspective view of the present centralizer invention illustrating the assembled straps and collars, yet rotated slightly from the view of FIG. 3.

Referring now to FIG. 4, there is shown a front perspective view of the centralizer 10 constructed in accordance with the present invention. The collars 12 and 14 attach to the straps 16, 18, 20 and 22 and are held in place by the collar locking ramps located on the bottom of the straps 16, 18, 20 and 22 as exemplified by collar locking ramp 27. The straps are thus spaced equidistant from each other around a given circumference. The end portions of the straps which pass through the collars 12 and 14 are the flexible strap finger portions as exemplified by flexible strap fingers 21 and 23. The flexible strap fingers 21 and 23 have well rounded edges as exemplified by well rounded edge 26 for user safety. Strap gussets as exemplified by strap gusset 24 provide additional reinforcement to the straps 16, 18, 20 and 22.

Each of the flexible strap fingers 21 and 23 has a tie wire slot as exemplified by tie wire slots 32 and 34. The end portion of the flexible strap fingers 21 and 231 which are adjacent to the tie wire slots 32 and 34 form a raised end ramp as exemplified by raised end ramp 30. This end ramp 30 portion provides a user with ease in assembly. In addition, the end ramp 30 has the primary function to prevent a tie wire from coming off the centralizer, securing and retaining the tie wire. The flexible strap fingers 21 and 23 have two locking tabs on the interior surface of the centralizer 10 straps as exemplified by lock tab 27. The lock tabs 27 fit snugly in place against the outer rim of the collars when assembled. The locking tab 27 holds the collar snugly and does not allow for any movement.

Compression tabs are located on the inner surface of each flexible finger portion of each strap. Such a compression tab is exemplified by compression tab 28. When the flexible finger portions of the straps are compressed into place around an elongated object to be centrally positioned in a bore hole, the compression tab 28 fits around the surface to enhance connection and mounting of the centralizer. Compression tab 28 may also fit directly into grooves such as those found in corrugated pipe. In this way the centralizer will not slip.

The collars 12 and 14 are also provided with a plurality of grout passage spaces, as exemplified by grout passage spaces 36 and 38.

Turning to FIG. 5, there is shown a back perspective view of an unassembled rigid strap 40. Each strap 40 is provided with a strap gusset 42 located on the midline of the strap rise 43. The strap gusset 42 is at its maximum width in the center of the strap rise 43 giving the most support at the point of greatest strain on the strap 40 during use. The strap gusset 42 provides reinforcement for the strap rise 43 which allows the strap rise 43 to be manufactured with less weight and less material, yet maintains the stability and strength of a much heavier strap rise. Those portions of the unassembled strap 40 which would extend past the holding collars form the flexible strap finger 44 and 46. The compression tabs 48 and 50 are clearly seen in this view as are the collar lock ramps 72 and 74. The bottom collar stoppers 66 and 68 which are extensions of the ends of the strap rise are also seen here. All surfaces have a well rounded edge as exemplified by well rounded edge 41.

Referring now to FIG. 6, there is seen a front perspective view of an unassembled strap 40. All surfaces of the unassembled strap 40 have a well rounded edge 41. A portion of the strap gusset 42 is seen running along the midline of the strap rise 43. The flexible strap fingers 44 and 46 are located on the end portions of the unassembled strap 40 on either side of the grooved collar fastening points 62 and 64. The portion on the strap 40 which includes the grooved collar fastening points 62 and 64 and the flexible strap fingers 44 and 46 are standard on all rigid straps 40. The grooved collar fastening points 62 and 64 enable the manufacturer to keep the material thickness constant to improve the cycle time of the molding process. In addition, the grooved collar fastening points 62 and 64 produce less friction when installing the collar and allows grout to flow inside to seal. The compression tabs 48 and 50 are located on the back of the strap in alignment with the tie wire slots 52 and 54. Next to the tie wire slots 52 and 54 are the raised end ramps 56 and 58.

Figure 7:
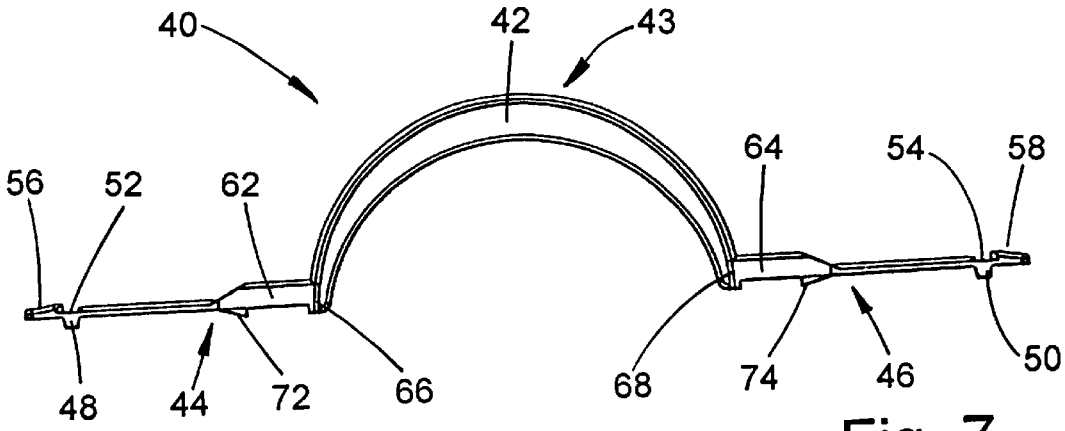
FIG. 7 is a side elevational view illustrating the strap in greater detail.

FIG. 7 is a side view of an unassembled strap 40. The strap gusset 42 runs the entire length of the strap rise 43 along the longitudinal midline of the strap rise 43. The bottom collar stoppers 66 and 68 are seen here as extensions of the strap rise 43 and strap gusset 42. The grooved collar fastening points 62 and 64 are adjacent to the strap rise 43.

The flexible strap fingers 44 and 46 begin past the grooved collar fastening points 62 and 64, and support the compression tabs 48 and 50 on the bottom side of the tie wire slots 52 and 54. The terminal ends of the flexible strap fingers are raised end ramps 56 and 58. Collar lock ramps 72 and 74 are located on the back side of the grooved collar fastening points 62 and 64.

Figure 8:
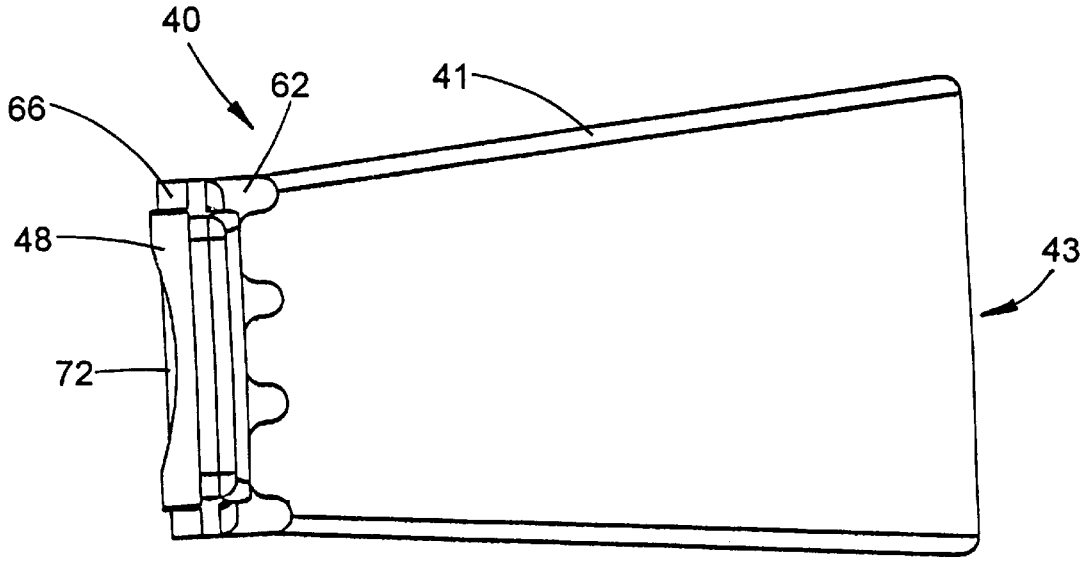
FIG. 8 is an enlarged plan view illustrating the strap in greater detail.

Referring to FIG. 8, there is seen an enlarged plan view of the unassembled strap 40. All of the edges of the unassembled strap 40 have well rounded edges as exemplified by well rounded edge 41. A grooved collar fastening points 62 is located at the end of the rise 43. A portion of the bottom collar stopper 66 may be seen from this view. The compression tab 48 as well as a portion of the collar lock ramp 72 are also seen from this view. The strap rise 43 width increases at the top of the rise 43 which allows for more surface contact and prevents digging into soft soils. In this way the centralizer strap act like a sled when lowering elongated objects to be centrally located into a bore hole. The width increases proportionally to the rise 43 of the strap 40.

Referring now to FIG. 9, an enlarged perspective view of a second embodiment 80 of one of the component collars is shown. This embodiment 80 provides three collar slots 82, 84 and 86 for three straps (see strap 40 above). In addition another embodiment of the previously described grout passage 83 is shown. In describing FIG. 4, the grout passage 36 on collar 12 had four portions. The present embodiment of the grout passage 83 on collar 80 has three portions. As before, these portions are bounded by slot sides 85. In this embodiment, collar 80, the slot sides 85 meet at angle 87. In either grout passage 83, a housing 88 may be laid to house a cable strand or to provide an additional passage way for grout through a grout tube. In fact, such a housing 88 may be laid in between any two adjacent collar slots (for example here between 82 and 84 or 84 and 86 or 82 and 86) in any collar or grout passage embodiment described herein.

Still describing FIG. 9, still another embodiment of the collar 80 may be used. At the angle 83, or between any other two slot sides, a single slit 89 may be cut into one or more of the collars to allow a user to manually spread the collar to snap over an anchor "rebar", rebar or strand encapsulated with corrugated pipe, or cable. This embodiment may be immensely practical and advantageous depending on the application on-site. The single slit 89 may even be made on-site. Only one such single slit 89 may be made in each of the collars or else collar integrity will be compromised.

Referring to FIG. 10, an enlarged perspective view of a typical embodiment of one of the standard collars 90 (similar to previously described collar 12) is shown. This embodiment collar 12 has four slots 92, 94, 96 and 98 to accommodate four straps (see strap 40 above).

Next referring to FIG. 11, an enlarged perspective view of a preferred embodiment of one of the typical collars 100 is shown. This embodiment of collar 100 has five slots 101, 102, 103, 104 and 105 for five straps (see strap 40 above).

Finally, referring to FIG. 12, an enlarged perspective view of another embodiment of one of the typical collars 110 is shown. This embodiment of collar 110 has six slots 111,112, 113,114,115 and 116 for six straps (see strap 40 above). It should be pointed out that as collar size increases, that is, as collars increase in capacity to accommodate more straps, the grout passages therein become more in number as well as wider in size, thereby allowing greater grout flow between centralizers placed into varying applications on job sites.

Figure 13:
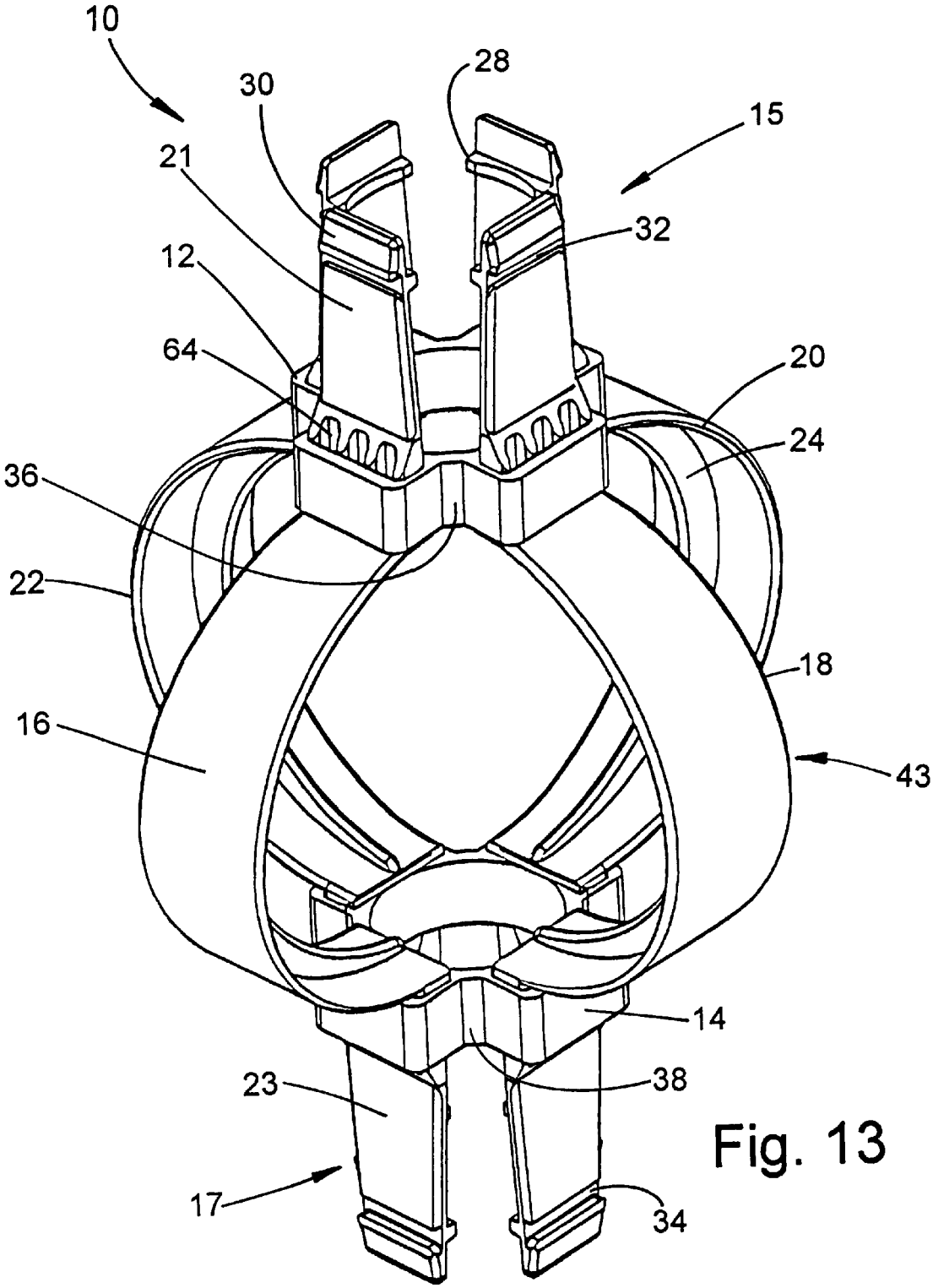
FIG. 13 is a front elevational perspective view of straps and collars assembled to form the finished centralizer, constructed in accordance with the present invention.

Referring now to FIG. 13 there is shown a front elevational perspective view of the fully assembled centralizer 10 constructed in accordance with the present invention. The collars 12 and 14 hold the straps 16, 18, 20 and 22. The portions of the straps which pass through the collars 12 and 14 and are above the grooved collar fastening points as exemplified by grooved collar fastening points 64 are the flexible strap finger portions as exemplified by flexible strap fingers 21 and 23. These flexible strap fingers 21 and 23 collectively form the flexible strap fingers area 15 and 17.

Each of the flexible strap fingers 21 and 23 each has a tie wire slot as exemplified by tie wire slots 32 and 34. The tie wire slots 32 and 34 are wide enough to accommodate zip ties as well as wire. The end portion of the flexible strap fingers 21 and 23 adjacent to the tie wire slots 32 and 34 and form a raised end ramp as exemplified by raised end ramp 30. This end ramp 30 portion provides a user with ease in assembly, and prevents tie wire slippage. In addition, the flexible strap fingers 21 and 23 have compression tabs on the interior surface of the centralizer 10 as exemplified by compression tab 28. The compression tabs 28 fit snugly in place against the outer surface of the object to be centralized such as bar thread, corrugate pipe or corrugated sheathing duct.

The collars 12 and 14 are also provided with a plurality of grout passages as exemplified by grout passages 36 and 38. The size of the grout passages 36 and 38 allows for a strand fixture or grout tube.

In FIGS. 14 through 21 a novel multiple configuration centralizer system embodiment is illustrated. This multiple configuration centralizer system is composed of standardized parts which are interchangeable and may be assembled and fastened to an anchor quickly and conveniently, on the job site, without the use of conventional tools.

Figure 14:
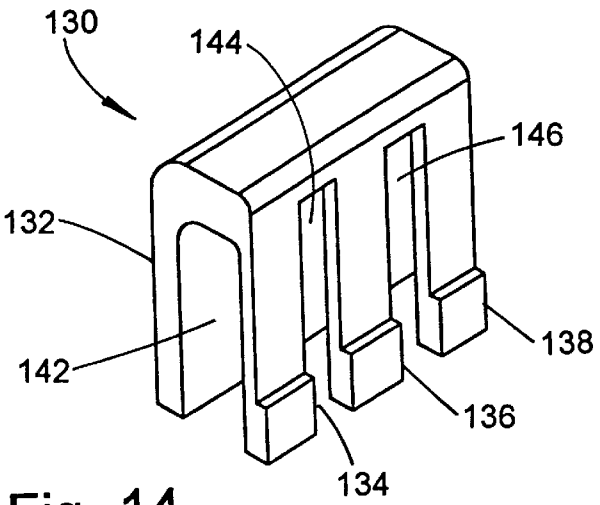
FIG. 14 is a perspective view of the bottom of the retainer clip.

Referring now to FIG. 14, a tie retainer clip 130 is illustrated. The tie retainer clip 130 has a thick walled upper surface 132 and clip fastening tines 134, 136 and 138 which are separated by spaces 144 and 146 to accept strap ridges at the grooved portion 64 of each strap 16 (as shown in FIG. 13). The tie retainer clip 130 is a standard size which accommodates all collars. A slot 142 for ties is located between the thick walled upper surface and the clip fastening tines 134, 136 and 138 and is constructed to provide a snug friction grip fit over zip ties.

Figure 15:
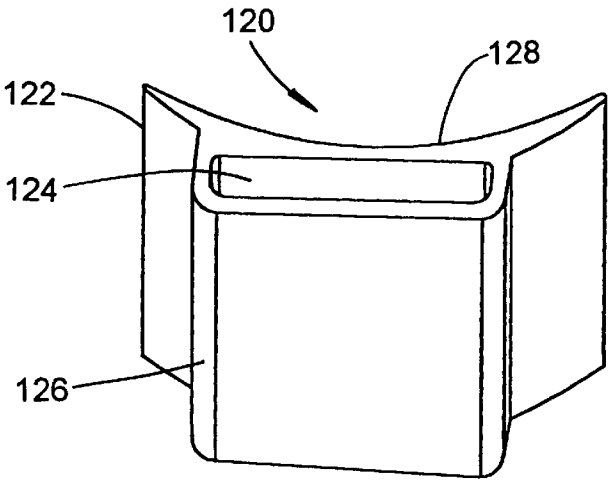
FIG. 15 is a perspective view of the top of a strap housing.

Turning now to FIG. 15, there is seen a strap housing 120 consisting of tapered flexible arms as exemplified by tapered flexible arm 122 and a thick walled rounded body 126. The flexibility of the tapered flexible arm 122 allows the strap housing 120 to adapt to various diameters of objects to be centralized. The strap housing 120 is standard and manufactured to fit all rigid straps. It also forms a "saddle" to prevent side shifting of the strap housing 120 when fastened or mounted to an anchor. The thick walled rounded body 126 retains straps and also prevents side movement of straps. A curved inner surface 128 is positioned frictionally on the outer perimeter of a device to be centralized. A slot 124 to accept a tie retainer clip is formed within the thick walled rounded body 126 of the strap housing 120.

Figure 16:
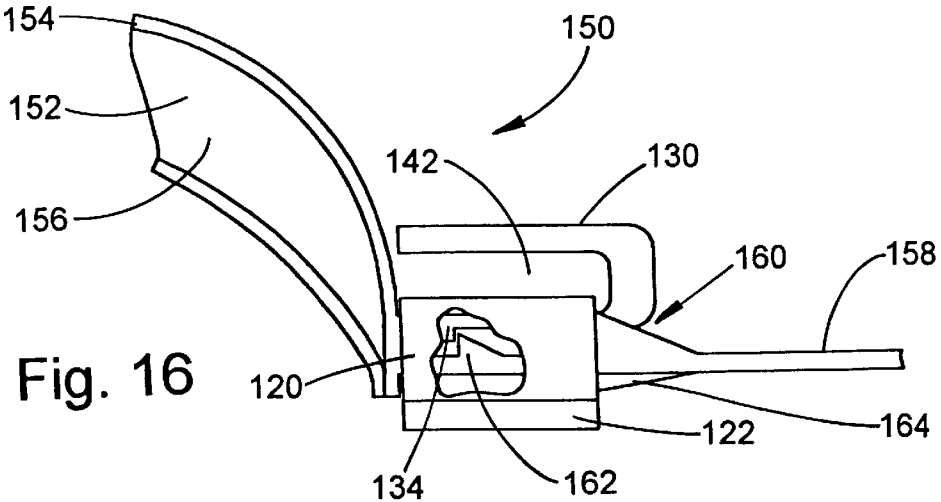
FIG. 16 is a partially cut-away side view of a portion of a strap housing/tie retainer clip assembly, illustrating the locking tab mechanism constructed in accordance with the present invention.

Referring now to FIG. 16, a strap housing/tie retainer clip assembly 150 is seen. A portion of the strap 152 and the rounded strap edge 154 as well as a strap gusset 156 are shown. A strap housing 120 with one of the tapered flexible arms 122 is shown as it would appear when mounted over the finger section 158 of strap. The collar lock ramp 164 keeps the strap housing 120 locked in this position. The collar lock ramp 164 is tapered to allow the strap housing 120 to slip on easier. The tie retainer clip 130 has been positioned with the clip fastening tine 134 inserted into the grooved collar fastening point 160 and held in place by several tie retainer clip lock ramps as exemplified by tie retainer clip lock ramp 162 in a cut away section of the strap housing 120. A slot 142 for accepting a zip tie remains open for insertion of the zip tie.

Figure 17:
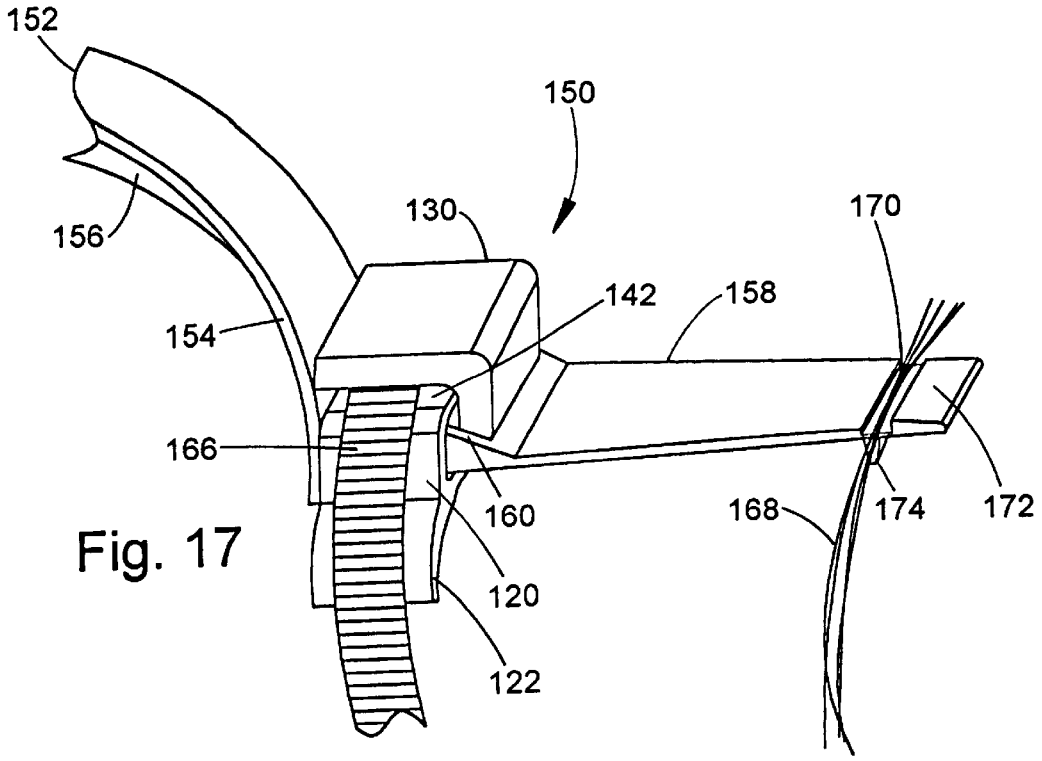
FIG. 17 is a perspective top view of the strap housing/tie retainer clip assembly with zip tie and tie wires in place, constructed in accordance with the present invention.

Turning to FIG. 17, a strap housing/tie retainer clip assembly 150 is illustrated with tie wires 168 running through the tie wire slot 170 and zip tie 166 as it would be seen when inserted through the slot 142 for tie. A portion of the strap 152 and the rounded strap edge 154 as well as a strap gusset 156 are shown. An elevated side perspective view of the strap housing 120 with one of the tapered flexible arms 122 is shown as it would appear when mounted over the grooved collar fastening point 160 of strap 152. The raised end ramp 172 helps to guide the tapered flexible arm 122 through the strap housing 120 and helps prevent the tie wire 168 from slipping off the strap housing/tie retainer clip assembly 150. The tie retainer clip 130 has been inserted into the grooved collar fastening point 160. The compression tab 174 is located on the back side of the strap 152 below the tie wire slot 170 and fits snugly on the outer surface of an object to be centralized.

Figure 18:
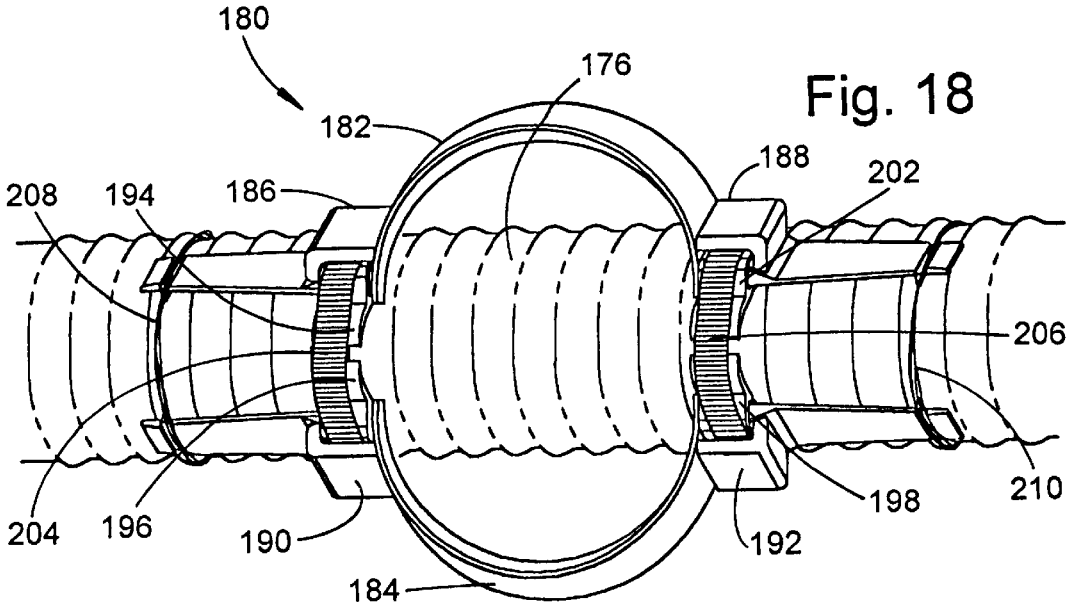
FIG. 18 is a side view of a multiple strap centralizer assembly as it might appear when securely mounted on a corrugated pipe using zip ties and tie wires.

Referring now to FIG. 18 there is seen a multiple strap centralizer assembly 180 consisting of several straps as exemplified by straps 182 and 184. Tie retainer clips 186, 188, 190 and 191 are held in place by the strap housings 194, 196, 198 and 202 which slip through the straps 182 and 184. Zip ties 204 and 206 form a friction fit through the tie retainer clips 186, 188, 190 and 192 and maintain the distance between straps 182, 184 at set intervals on the multiple strap centralizer assembly 180. The multiple strap centralizer assembly 180 is held in place on the corrugated pipe or rebar 176 by the constriction of the zip ties 204 and 206 and by tie wires 208 and 210.

Figure 19:
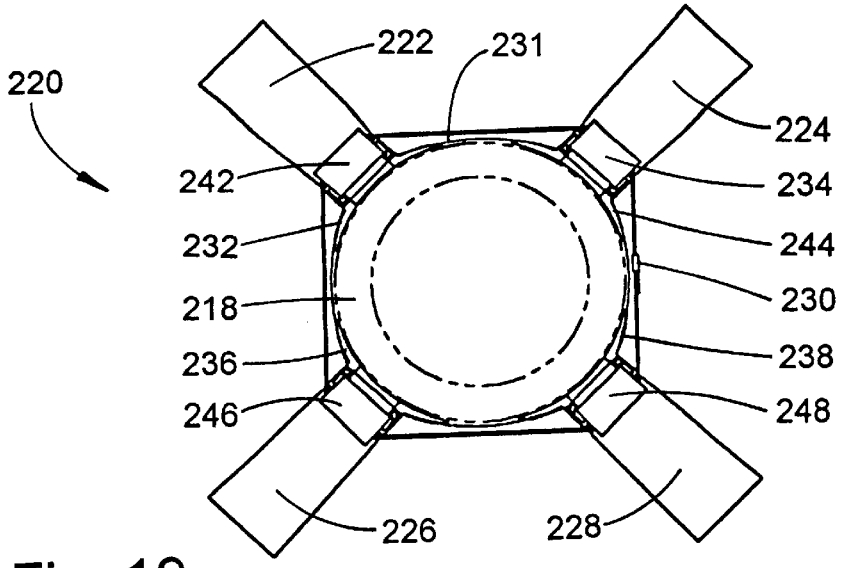
FIG. 19 is a plan view of a 4-strap centralizer assembly as it might appear when securely mounted on a corrugated pipe using zip ties and tie wires.

FIG. 19 shows a plan view of a 4-strap centralizer assembly 220 mounted on a corrugated pipe or rebar 218. The strap housings 232, 244, 236 and 238 are mounted to the straps 222, 224, 226 and 228 with the tie retainer clips 242, 234, 246 and 248 inserted into the strap housings 232, 234, 236 and 238. The zip tie 230 is inserted through the tie retainer clips 242, 234, 246 and 248 and frictionally maintain the distances between the straps 222, 224, 226 and 228. The zip tie 230 when cinched down tightly, together with the tie wire 231 help hold the 4-strap centralizer assembly 220 in place when mounted on any elogated object to be centrally positioned within a bore hole, such as corrugated pipe or rebar 218.

Figure 20:
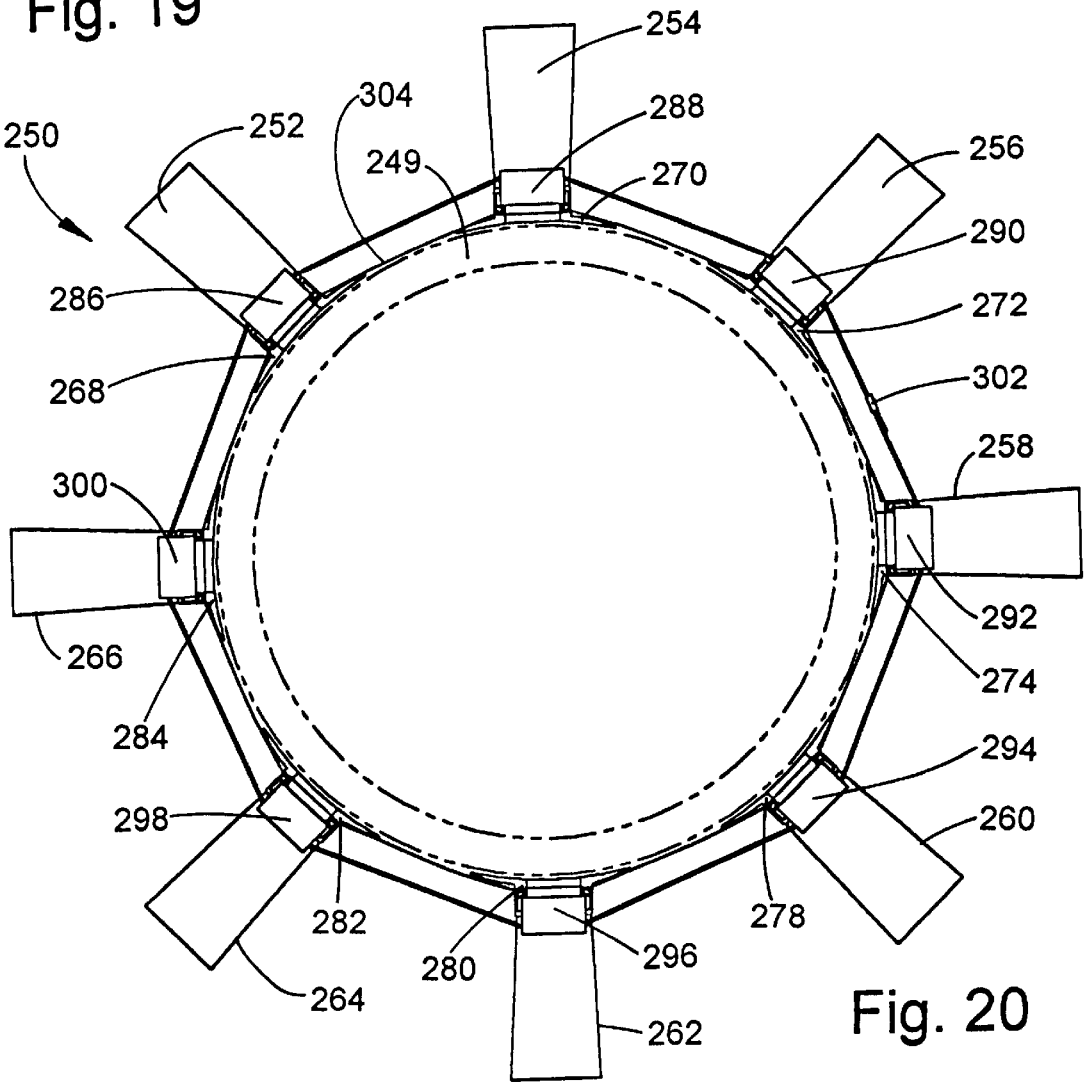
FIG. 20 is a plan view of an 8-strap centralizer assembly as it might appear when securely mounted on a corrugated pipe using zip ties and tie wires.

Turning to FIG. 20, an 8-strap centralizer assembly 250 is illustrated. The strap housings 268, 270, 272, 274, 278, 280, 282 and 284 are mounted to the straps 252, 254, 256, 258, 260, 262, 264 and 266 with the tie retainer clips 286, 288, 290, 292, 294, 296, 298 and 300 inserted into the strap housings 268, 270, 272, 274, 278, 280, 282 and 284. The zip tie 302 is inserted through the tie retainer clips 286, 288, 290, 292, 294, 296, 298 and 300 and frictionally maintain the distances between the straps 252, 254, 256, 258, 260, 262, 264 and 266. The zip tie 302 when cinched down tightly together with the tie wire 304 help hold the 8-strap centralizer assembly 250 in place when mounted on a corrugated pipe or rebar 249.

Figure 21:
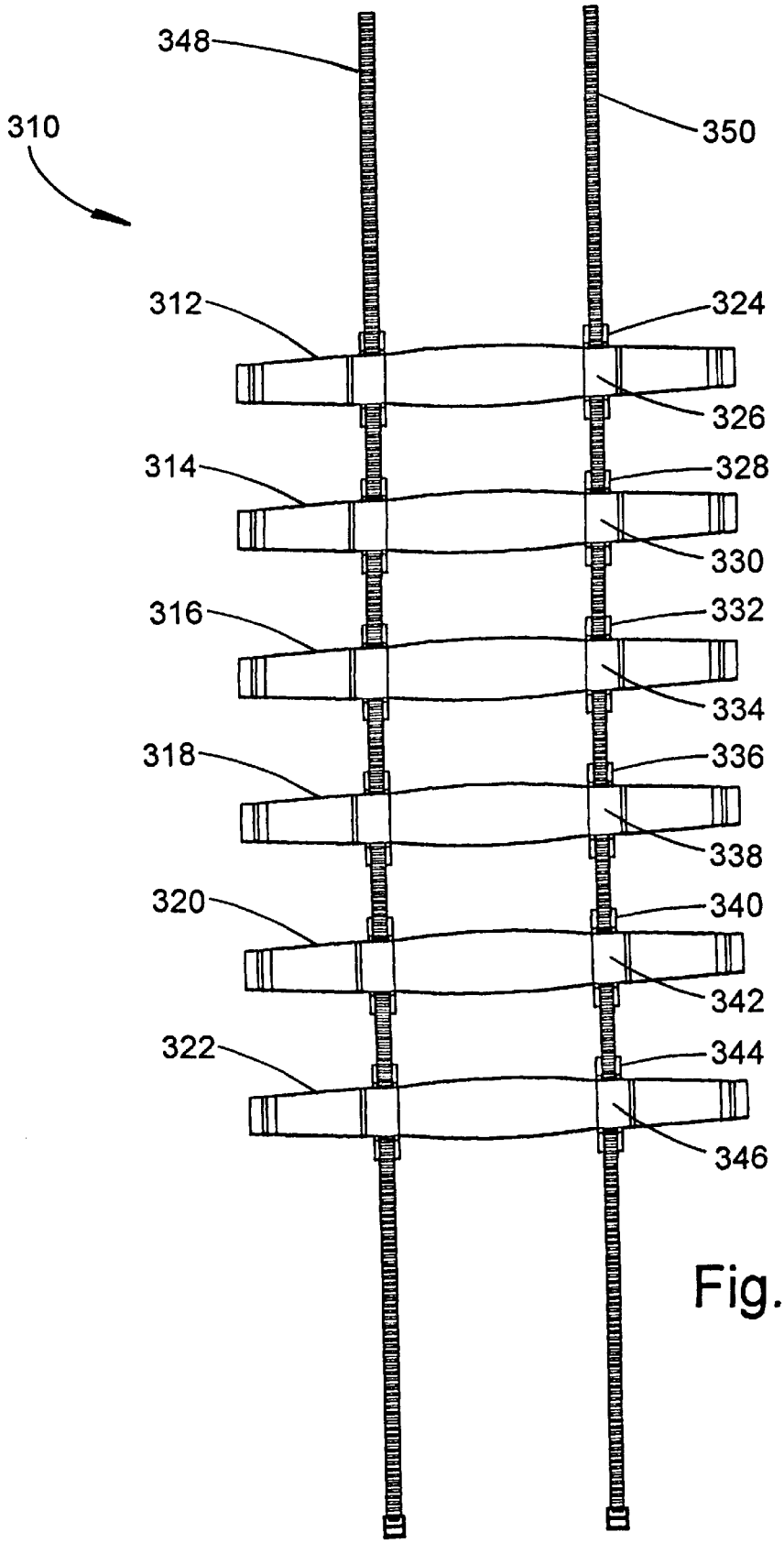
FIG. 21 is a side elevational view of a 6-strap multiple configuration centralizer ladder-like assembly as it might appear when shipped, or prior to mounting on-site.

FIG. 21 shows a 6-strap ladder assembly 310 as it would be seen as shipped and prior to mounting on pipe, corrugated sheathing, rebar, or any other large diameter anchor. The strap housings 324, 328, 332, 336, 340 and 344 are mounted to the straps 312, 314, 316, 318, 320 and 322 with the tie retainer clips 326, 330, 334, 338, 342 and 346 inserted into the strap housings 324, 328, 332, 336, 340 and 344. The zip ties 348 and 350 are inserted through the tie retainer clips. For example zip tie 350 is inserted through tie retainer clips 326, 330, 334, 338, 342 and 346 and frictionally maintain the distances between the straps 312, 314, 316, 318, 320 and 322 during shipping but the distances between the straps 312, 314, 316, 318, 320 and 322 may be adjusted in the field without the use of tools.

In the field, the radius of the riser portion of the rigid strap determines the size selection of the rigid strap to use in a given bore hole application. Please refer to Table 1. below for the Rigid Centralizer Sizing Chart.

TABLE 1

RIGID CENTRALIZER SIZING CHART

| Strap Rise (inches) | Overall Size (inches) |
|---|---|
| 1) 1.25" I.D. collar with 1.50" cross-section: | |
| 1.00 | 3.50 |
| 1.25 | 4.00 |
| 1.50 | 4.50 |
| 1.75 | 5.00 |
| 2.00 | 5.50 |
| 2.25 | 6.00 |
| 2.50 | 6.50 |
| 2.75 | 7.00 |
| 3.00 | 7.50 |
| 3.25 | 8.00 |
| 2) 1.50" I.D. collar with 1.75" cross-section: | |
| 1.00 | 3.75 |
| 1.25 | 4.25 |
| 1.50 | 4.75 |
| 1.75 | 5.25 |
| 2.00 | 5.75 |
| 2.25 | 6.25 |
| 2.50 | 6.75 |
| 2.75 | 7.25 |
| 3.00 | 7.75 |
| 3.25 | 8.25 |
| 3) 1.75" I.D. collar with 2.00" cross-section: | |
| 1.00 | 4.00 |
| 1.25 | 4.50 |
| 1.50 | 5.00 |
| 1.75 | 5.50 |
| 2.00 | 6.00 |
| 2.25 | 6.50 |
| 2.50 | 7.00 |
| 2.75 | 7.50 |
| 3.00 | 8.00 |
| 3.25 | 8.50 |
| 4) 2.00" I.D. collar with 2.25" cross-section: | |
| 1.00 | 4.25 |
| 1.25 | 4.75 |
| 1.50 | 5.25 |
| 1.75 | 5.75 |

TABLE 1-continued

RIGID CENTRALIZER SIZING CHART

| Strap Rise (inches) | Overall Size (inches) |
|---|---|
| 2.00 | 6.25 |
| 2.25 | 6.75 |
| 2.50 | 7.25 |
| 2.75 | 7.75 |
| 3.00 | 8.25 |
| 3.25 | 8.75 |
| 5) 2.43 I.D. collar with 2.625" cross-section: | |
| 1.00 | 4.625 |
| 1.25 | 5.125 |
| 1.50 | 5.625 |
| 1.75 | 6.125 |
| 2.00 | 6.625 |
| 2.25 | 7.125 |
| 2.50 | 7.625 |
| 2.75 | 8.125 |
| 3.00 | 8.675 |
| 3.25 | 9.125 |
| 6) 2.75" I.D. collar with 3.00" cross-section: | |
| 1.00 | 5.00 |
| 1.25 | 5.50 |
| 1.50 | 6.00 |
| 1.75 | 6.50 |
| 2.00 | 7.00 |
| 2.25 | 7.50 |
| 2.50 | 8.00 |
| 2.75 | 8.50 |
| 3.00 | 9.00 |
| 3.25 | 9.50 |

NOTE: When sizing centralizers, 0.25" must be added to the collar I.D. This is the typical collar wall thickness × 2. Therefore, a 1.25" I.D. collar measures 1.50" + strap rise × 2 = centralizer O.D.

The present invention improves or provides the solutions to the many problems previously associated with centralizers. Just a few of those solutions described herein include simplifying and improving the locking mechanism of the straps into the collars, incorporating a multiple configuration centralizer device readily assembled from standardized components to adapt to various diameter bore holes and anchors, improving the grout passage, eliminating the need for use of conventional tools in assembly of the centralizer, and a greatly lowered cost of manufacturing because of the use of a lightweight, moldable, and strong material. Now, many applications may be served by the present invention, instead of each application requiring a separately designed and expensively manufactured centralizer device.

It should be understood, however, that even though these numerous characteristics and advantages of the invention have been set forth in the foregoing description, together with details of the structure and function of the invention, the disclosure is illustrative only, and changes may be made in detail, especially in matters of shape, size, chemistry and arrangement of parts within the principal of the invention to the full extent indicated by the broad general meaning of the terms in which the appended claims are expressed.

What is claimed is:

1. A rigid manually assembled centralizer system comprising:

(a) two generally cylindrical collars having three or more slots;

(b) a plurality of rigid strap members manually insertable into said collar slots;

(c) means for locking said rigid strap members into said collar slots;

(d) means for affixing said manually assembled centralizer system onto an elongated object to be inserted into a bore hole said elongated object requiring central positioning in said bore hole, whereby said elongated objects of various diameters can be readily accommodated by said affixed centralizer; and (e) means for providing a plurality of grout passages in said collars.

2. A centralizer system according to claim 1, wherein said generally cylindrical collars are constructed so as to accept, and thereby be fixedly attached to, three or more of said strap members.

3. A centralizer system according to claim 1, wherein said collars and said rigid strap members are constructed of thermoplastic material selected from the group consisting of polypropylene and polyethylene.

4. A centralizer system according to claim 1, wherein said means for locking said rigid strap members into said collar slots includes a locking ramp positioned on an inside surface of said rigid strap member, whereby when said strap is inserted in to said collar slot, said locking ramp prevents movement of said collar along said strap.

5. A centralizer system according to claim 1, wherein said means for affixing said manually assembled centralizer system onto an elongated object to be inserted into a bore hole requiring central positioning in said bore hole includes strap members constructed so as to integrally include two separate flexible finger portions whereby said finger portions flex toward and snugly fit onto an elongated object to be centrally positioned in a bore hole, and whereby said finger portions allow for the centralizer to be mounted using tie wire or zip tie.

6. A centralizer system according to claim 1, wherein said rigid strap members include a central portion semi-circular tapered riser which widens at its peak, and which radius determines the size of rigid strap to use in a given bore hole application, whereby said tapered riser which broadens in the center adds strength to said rigid strap member, and allows for less difficulty in inserting said centralizer system into said bore hole due to increased surface area.

7. A centralizer system according to claim 1, wherein said means or affixing said manually assembled centralizer system onto an elongated object to be inserted into a bore hole requiring central positioning in said bore hole includes strap members having a groove on each distal end to permit tie wire or a zip tie to be immobilized for the purpose of mounting snugly said centralizer to said elongated object to be centrally positioned in said bore hole.

8. A centralizer system according to claim 1, wherein said rigid strap members include a centrally located gusset on one side, positioned within the curved inner portion to provide strength and reinforcement to said strap member.

9. A centralizer system according to claim 1, wherein said rigid strap members include a multiply grooved collar accepting portion defined by four raised elements forming three grooves, with each groove having a locking tab therein.

10. A centralizer system according to claim 1, wherein said strap members include one or more compression tabs on each end for enhanced attachment to earth anchor rebar, corrugated pipe or earth anchor cables, and wherein said strap member compression tabs are radially cut to provide a tighter conformed attachment to rounded earth anchor rebar and earth anchor cables.

11. A centralizer system according to claim 1, wherein said collars include one slit to allow for the rapid mounting of the assembled centralizer system onto an elongated object without the need to slide the centralizer system down the length of said elongated object.

12. A multi-configuration rigid strap centralizer system comprising:

(a) a plurality of rigid straps having a multiply grooved collar accepting portion defined by four raised elements forming three grooves, with each groove having a locking tab therein proximal to a riser portion with locking ramps within each groove and a locking ramp on the surface opposite the surface supporting said multiply grooved portion;

(b) a retainer housing having a single slot, each of said rigid straps being manually insertable into said retainer housing slot and locked into place by said locking ramp;

(c) a tie retainer clip having a plurality of clip fastening tines each having a raised portion, said tines insertable into said slot, whereby said tie retainer clip is locked into place within said slot and said multiply grooved collar accepting portion such that the raised portion of said tines locks into the locking ramps within said multiply grooved collar accepting portion of said strap; and (d) whereby said single slot is capable of accepting a zip tie such that said centralizer is formed around an elongated object by threading a zip tie through each strap slot formed by the connection of said strap housing and said tie retainer clip and mounting said centralizer system through the conventional connection of the zip tie ends, then tightening the zip tie until said strap housings make contact with said elongated object to be centrally positioned, and said centralizer system is snugly in place around said elongated object.

13. A multi-configuration rigid strap centralizer system according to claim 12 wherein said retainer housing having a single slot includes a lower curved surface with tapered ends such that the strap housing will fit snugly onto rounded elongated objects to be centrally positioned as the tapered end will flex to the proper curvature.

14. A multi-configuration rigid strap centralizer system according to claim 12 wherein said retainer housing having a single slot and said tie retainer clip, when locked into place upon said rigid strap, form a slot to accept a conventional zip tie such that the zip tie is frictionally tightly held in place within said slot.

15. A multi-configuration rigid strap centralizer system according to claim 12 wherein a plurality said strap housings are fitted with a tie retainer clip and are economically shipped to, and provided on-site in a ladder-like configuration with two zip ties snugly connecting each end of each strap within a slot formed by the mounting of a tie retainer clip.

16. A multi-configuration rigid strap centralizer system according to claim 12 wherein said centralizer system components, straps, collars, zip ties, single strap housings and retainer clips are constructed of molded thermoplastic material selected from the group consisting of polypropylene and polyethylene.

17. A method of using a centralizer system for centering an earth anchor mechanism within a bore hole comprising the steps of:

(a) providing a centralizer system having numerous strap housings and rigid strap members which are readily manually assembled on-site requiring no tools;

(b) sliding one or more of said centralizers onto a rebar, cable, bundle of cables or corrugated pipe encapsulated rebar or strand or other earth anchor mechanism;

(c) affixing one end of the centralizer to the earth anchor mechanism using a tie wire, zip tie, adhesive tape or any combination thereof;

(d) affixing the other end of said centralizer to the earth anchor mechanism using a tie wire, zip tie, adhesive tape or any combination thereof; and (e) continuing the process with other centralizers if any that have been slid onto said earth anchor mechanism, whereby said centralizers are proportionally spaced apart to hold said earth anchor mechanism in a centered position once lowered into a bored hole for accepting said earth anchor.

18. A method of using a centralizer system for centering an earth anchor mechanism within a bore hole according to claim 17, wherein said step of providing a centralizer system having numerous strap housings includes providing strap collars having three or more strap accepting slots.

19. A method of using a centralizer system for centering an earth anchor mechanism within a bore hole according to claim 17, wherein said step of providing a centralizer system having numerous strap housings includes providing straps and strap housings which are pre-fitted with a tie retainer clip and provided on-site in a ladder-like configuration with two zip ties snugly connecting each end of each strap within a slot formed by the mounting of a tie retainer clip.

20. A method of using a centralizer system for centering an earth anchor mechanism within a bore hole according to claim 17, wherein said step of providing said centralizer system includes the shipping said centralizer system in unassembled component form and manually assembling said components, straps, collars, zip ties, single strap housings and retainer clips on-site, whereby all shipped centralizer system components are constructed of molded thermoplastic material selected from the group consisting of polypropylene and polyethylene.

* * * * *